United States Patent [19]

Morris

[11] 4,428,749

[45] Jan. 31, 1984

[54] FABRIC WASHING PROCESS AND DETERGENT COMPOSITION FOR USE THEREIN

[75] Inventor: Ronald M. Morris, Wirral, England

[73] Assignee: Lever Brothers Company, New York, N.Y.

[21] Appl. No.: 338,945

[22] Filed: Jan. 12, 1982

[30] Foreign Application Priority Data

Jan. 14, 1981 [GB] United Kingdom ..... 8101120

[51] Int. Cl.[3] ..... C11D 3/06; C11D 11/00; C11D 17/06

[52] U.S. Cl. ..... 8/137; 252/90; 252/91; 252/135; 252/174; 252/174.13

[58] Field of Search ..... 8/137; 252/90, 91, 135, 252/174, 174.13

[56] References Cited

U.S. PATENT DOCUMENTS

| | | | |
|---|---|---|---|
| 2,381,960 | 8/1945 | Johnson | 210/697 |
| 3,516,937 | 6/1970 | Story | 252/110 |
| 4,234,442 | 11/1980 | Cornelissens | 252/90 |

FOREIGN PATENT DOCUMENTS

| | | | |
|---|---|---|---|
| 2642071 | 3/1977 | Fed. Rep. of Germany | 252/135 |
| 996193 | 6/1965 | United Kingdom | 252/90 |
| 1224777 | 3/1971 | United Kingdom | 252/135 |

*Primary Examiner*—Dennis L. Albrecht

*Attorney, Agent, or Firm*—Milton L. Honig; James J. Farrell

[57] ABSTRACT

A process for washing fabrics includes contacting the fabrics with a liquor containing an orthophosphate material and, at least one minute thereafter, contacting the fabrics with a liquor containing a pyrophosphate material free of polymer phosphate. Each liquor contains a detergent active material and has a pH between about 8 and about 12. The delayed contact with the pyrophosphate reduces the level of deposition on the fabrics and the use of a combination of orthophophate and pyrophosphate enables compositions for use in the process to contain lower than conventional total levels of phosphorus. The pyrophosphate containing liquor may be separate from the orthophosphate containing liquor, or it may be the same liquor to which the pyrophosphate is added with a suitable delay. This delay may be achieved by the separate addition of the pyrophosphate material, by the use of a two compartment sachet, by coating, encapsulation or co-granulating the pyrophosphate, or by selecting a particle size for the pyrophosphate which will sufficiently reduce its rate of dissolution.

6 Claims, No Drawings

FABRIC WASHING PROCESS AND DETERGENT COMPOSITION FOR USE THEREIN

FIELD OF THE INVENTION

The present invention relates to fabric washing processes and to the compositions which are adapted for this purpose, using synthetic detergent active compounds together with phosphate detergency builders. The invention concerns in particular fabric washing using detergent compositions which contain levels of the phosphate detergency builders which can be lower than conventional phosphate builder levels, whilst still achieving good detergency results.

BACKGROUND OF THE INVENTION

A detergent dishwashing composition is known from GB No. 1 224 777 (Armour) which is intended for use at substantially neutral pH and which contains in addition to an acid orthophosphate, encapsulated sodium tripolyphosphate with the object of providing good cleaning action over an extended period of time.

It is also known to wash fabrics in two steps. Thus GB 996 193 (Henkel) describes adding a first concentrate to water to form a wash liquor and subsequently adding a second concentrate to the same liquor. By suitable choice of components in these concentrates, enhanced bleaching of fabrics can be obtained.

U.S. Pat. No. 2,381,960 (Dupont) describes the delayed addition of pyrophosphate to orthophosphate containing liquors for water softening, the pyrophosphate being added prior to the formation of a macroscopic precipitate of calcium orthophosphate.

SUMMARY OF THE INVENTION

The present invention on the other hand is concerned with low phosphorus containing fabric washing compositions having enhanced building properties and a reduced level of deposition on the fabrics.

According to a first aspect of the invention there is provided a process for washing fabrics comprising the steps of:

(i) contacting the fabrics with a wash liquor containing a synthetic detergent active compound and an alkalimetal or ammonium orthophosphate; and (ii) subsequently contacting the fabrics with a wash liquor containing a synthetic detergent active compound and an alkalimetal or ammonium pyrophosphate, each of said wash liquors having a pH between about 8 and about 12 and each of said wash liquors containing substantially no alkalimetal or ammonium polymerphosphate, the fabrics being in contact with said wash liquor containing said orthophosphate for at least one minute before contacting the fabrics with said wash liquor containing said pyrophosphate.

The process can be conducted if desired in two stages, for example using a prewash as step (i) and then a main wash as step (ii), the fabrics being substantially separated from the prewash liquor before being contacted with the main wash liquor. In this event there is often some carry-over of the ingredients in the pre-wash into the main wash, so that there is some benefit from the presence of residual alkalimetal orthophosphate in the main wash liquor. Many modern domestic washing machines are designed for sequential pre- and main washes, or the consumer may himself arrange the sequential washing.

Alternatively, the washing process can be conducted in a single stage, where the liquor used in step (i) remains in contact with the fabrics during step (ii). This can be achieved by including the pyro-phosphate together with the orthophosphate and synthetic detergent compound in a single composition, but treating the former to delay its dissolution so that in step (i) it remains in an undissolved form, or by adding the pyrophosphate to the wash solution later than the other ingredients. This can again be achieved manually or automatically. Dissolution of the pyro-phosphate is preferably delayed for at least two minutes, especially at least 5 to 30 minutes, or even more after dissolution of the bulk of the orthophosphate, to encourage maximum precipitation of calcium orthophosphate before addition of the former. By this is meant that the pyrophosphate is added when at least half of the calcium water hardness has been precipitated as a macroscopic precipitate of calcium orthophosphate.

According to the second aspect of the invention there is provided a detergent composition for carrying out such a method, comprising a synthetic detergent active compound, an alkalimetal or ammonium orthophosphate and an alkalimetal or ammonium pyro-phosphate characterised by means for delaying the solubility of said alkalimetal or ammonium pyro-phosphate for at least one minute when the composition is added to water to form a wash liquor, said composition yielding a pH of between about 9 and about 11 when dissolved in 12° H (Ca) water at 50° C. and at a concentration of 0.1% w/v, and said composition containing substantially no alkalimetal polymerphosphate.

The detergent composition may be in the form of two containers, the first container containing at least a part of said synthetic detergent active compound and the orthophosphate and the second container containing the alkalimetal or ammonium pyro-phosphate and optionally a further part of the synthetic detergent active compound. In use, the contents of the first container are released into water to form a wash liquor for step (i) of the process and subsequently the contents of the second container are released to form a wash liquor for step (ii) of the process.

The delayed addition of the pyro-phosphate to the washing solution is advantageous in giving decreased deposition of inorganic phosphates on the washed fabric, compared with the simultaneous addition of the pyrophosphate and orthophosphate. It is believed that this is due to the substantially complete precipitation of calcium orthophosphate by reaction with hard water before dissolution of the pyro-phosphate.

DETAILED DESCRIPTION OF THE INVENTION

The washing process of the invention can be accomplished manually, if desired, but is normally accomplished in a domestic or commercial laundry washing machine. The latter permits the use of higher wash temperatures and alkalinity, and more agitation, all of which contribute generally to better detergency. High wash temperatures (at least about 60° C.) and high alkalinity (over about pH 10) also particularly assist the precipitation of the calcium orthophosphate to achieve more effective water softening. However, any wash temperature between ambient and boiling may be employed with any normal degree of alkalinity (pH 8–12).

The type of washing machine used, if any, is not significant.

It is preferred to accomplish the washing process in a joint presence of both the orthophosphate and the pyrophosphate, but with the dissolution of the latter being delayed, as described above. This has the advantage of combining the water-softening action of both phosphates. This means, referring to the process of the invention, that the first aqueous solution is used to prepare the second aqueous solution. An added advantage is that the detergent active compound used in both solutions can then be the same substance or mixture of substances.

It should be appreciated that when in aqueous solution in hard water, the alkalimetal or ammonium orthophosphate and pyro-phosphate will be present wholly or partially in the form of the calcium or magnesium salts, which are insoluble for the orthophosphates and soluble chelates in the case of the pyro-phosphate. But for convenience the phosphates will be referred to generally as being in the alkalimetal or ammonium salt form as appropriate, as if the aqueous solutions were prepared with de-ionised water.

The detergent compositions used in the process of the invention may be either solid or liquid compositions. Either physical form can be used if the orthophosphate and pyro-phosphate are included in different compositions for separate addition to the wash liquor. Compositions in liquid form are suitable in particular for commercial laundry use, in which bulk supplies of aqueous orthophosphate and pyro-phosphate solutions are available and are automatically dosed to the washing machines at the appropriate times in the wash cycle. But if the orthophosphate and pyro-phosphate are included in a single composition, with the latter being treated to delay its solubility, the composition will normally be in solid form, eg as a powdered or granulated product.

The invention includes processes for the preparation of such detergent compositions suitable for fabric washing according to the invention, by forming a detergent base powder containing a detergent active compound or compounds and optionally the alkalimetal orthophosphate, and admixing with the base powder any further orthophosphate and an alkalimetal or ammonium pyro-phosphate, treated to delay its dissolution in water.

Preferably the base powder is prepared by spray drying in the normal way using conventional equipment and process conditions. However, other conventional techniques may be used for preparing the base powder containing the detergent active compound and usually the orthophosphate. Other heat-sensitive ingredients may also be admixed with the base powder together with or separately from the treated alkalimetal or ammonium pyro-phosphate, for example oxygen bleach compounds such as sodium perborate.

The alkalimetal polymer-phosphate which is substantially absent in the compositions of the invention is for example sodium tripolyphosphate, or the potassium or ammonium salts. The alkalimetal polymer-phosphates are generally represented as having the formula $M_2(MPO_3)_n$ where M is sodium, potassium or ammonium and n is an integer equal to or greater than 3.

If the pyro-phosphate is treated to delay its dissolution, for inclusion in a single composition with the orthophosphate, this may be accomplished in the production of the pyro-phosphate or subsequently.

Specifically, the pyro-phosphates may be made with a large particle size or the pyro-phosphate may be coated or encapsulated with a slowly soluble material such as wax, nonionic detergent compounds, higher fatty acids or a protein such as gelatin. The rate of solubility of the pyro-phosphates may also be decreased by using them in partial calcium, zinc or other polyvalent salt form. Two or more of these treatments may also be combined, so as to give close control over the solubility of the pyrophosphate under the recommended washing conditions.

The rate of solubility of the pyro-phosphate may also be controlled by granulating the pyro-phosphate with sodium silicate. Specifically, the granules may contain a $M_2O:SiO_2$ ratio from about 1:2 to about 1:3.75 wherein M is an alkalimetal, the granule being dried to a moisture content of less than 7% by weight. A particularly useful granule of this type can be achieved by granulating 1 part of pyro-phosphate with 3 parts of sodium silicate having an $Na_2O:SiO_2$ ratio of 1:2. The pyrophosphate-containing granule may also contain a portion of the synthetic detergent-active compound.

U.S. Pat. No. 4,040,988 (Benson) describes granules formed by sequestering builders and alkalimetal silicates and may be referred to in this connection.

The delayed solubility of the pyro-phosphate may also be achieved by dosing the composition in a two-compartment sachet, the sachet being so constituted that when added to water the contents of the first compartment, namely the alkalimetal orthophosphate and at least some of the synthetic detergent active compound are released before the contents of the second compartment, namely the alkalimetal or ammonium pyro-phosphate and optionally a further part of the synthetic detergent active compound.

A suitable sachet of this type may be made from a first outer sheet of polyethylene film, a second outer sheet of acrylic bonded polyester/viscose non-woven fabric and an inner sheet of thermally bonded polypropylene non-woven fabric, these three sheets being heat-sealed together at the edges to define a sachet with two compartments. Before sealing the final edge, the first compartment between the two layers of non-woven fabric may be filled with the orthophosphate and at least some of the synthetic detergent active compound. The second compartment may be filled with the alkalimetal or amonium pyrophosphate and optionally a further part of the synthetic detergent active compound.

In use the contents of the second compartment are released after those of the first compartment because they must pass through the first compartment before entering the wash liquor.

The solution of the pyro-phosphate may also be delayed by coating or encapsulating the pyro-phosphate with a water-dispersible water-insoluble material or with a water-soluble material. Examples of such coating materials include fatty acids, alkanolamines of fatty acids, glycerol esters of fatty acids, long chain hydrocarbon aliphatic alcohols, paraffin waxes, mineral oil, gelatin, sugar, non-ionic surface active agents, polyvinyl alcohol and sodium carboxymethylcellulose as described in U.S. Pat. No. 3,847,830 (Williams) and GB No. 1 242 247 (Unilever).

The orthophosphate used in either potassium or preferably sodium orthophosphate, as the latter is cheaper and more readily available. Ammonium orthophosphate may also be used, particularly if the composition is not made by spray drying. Normally the tri-alkali metal salts are used, but orthophosphoric acid or the di- or mono-alkalimetal salts, eg disodium hydrogen orthophosphate or monosodium dihydrogen orthophosphate could be used if desired in the production of the compositions. In the latter event other more alkaline salts should also be present to maintain a high pH in the end product, ie with full neutralisation to the tri-alkalimetal orthophosphate salts. The use of a mixture of the monosodium dihydrogen and disodium hydrogen orthophosphates in the ratio 1:3 to 2:3, especially about 1:2, is particularly advantageous, as such a mixture (known as kiln-feed) is made in the production of sodium tripolyphosphate and is readily available.

The orthophosphate can be used in the form of the anhydrous or hydrated salts, but in the former case it is preferred to promote hydration during processing, eg by adding the anhydrous orthophosphate to a detergent slurry and spray drying to form a base powder. The alkali metal pyro-phosphates do not form hydrated salts as such, and are normally used in predominantly anhydrous form. The amounts of salts used are expressed in anhydrous form.

The total amounts of the essential pyro-phosphate and orthophosphate, and any other phosphates which may be present in the detergent compositions, are chosen according to the overall detergency builder level which is desired in the detergent compositions or according to the maximum permitted phosphorus content. Normally, when both the orthophosphate and pyro-phosphate are present in a single composition, the total phosphate builder level, which is preferably derived solely from the alkalimetal pyrophosphate and orthophosphate, is between about 5% and about 50%, preferably about 10% to about 30% by weight of the composition, with an amount of about 2% to about 20% each of the pyro-phosphate and orthophosphate. Preferably the amounts of the pyro-phosphate and orthophosphate are each from about 5% to about 15%, especially about 5% to 10% by weight of the product. The total amount of pyro-phosphate and orthophosphate is preferably from about 10% to about 25%, especially about 15% to about 20%, by weight of the composition.

It is generally preferred to have amounts of the orthophosphate and the pyro-phosphate, within the ratio of from about 3:1 to about 1:3 especially about 2:1 to about 1:2, parts by weight. These ratios of pyro-phosphate to orthophosphate are particularly suitable for detergent compositions used at relatively high product concentrations ie 0.3% to 0.8% by weight as is common practice in Europe, especially in front-loading automatic washing machines, and where moderate levels of phosphates are allowed in the products, ie equivalent to 2% to P.

It is preferable that the only phosphate detergency builders used in the process of the invention should be the pyro-phosphate and orthophosphate. In particular, it is desirable to use no alkalimetal, ie sodium or potassium, polymer-phosphates in the compositions as this tends to increase inorganic deposition as mentioned above.

The process of the invention is necessarily accomplished using synthetic anionic, nonionic, amphoteric or zwitterionic detergent active compound or mixtures thereof. Detergent compositions normally include from about 2.5% to about 50%, preferably about 5% to about 30%, and especially about 10% to about 25% by weight of such ingredients. Many suitable detergent compounds are commercially available and are fully described in the literature, for example in "Surface Active Agents and Detergents", Volumes I and II, by Schwartz, Perry & Berch.

The preferred detergent compounds which can be used are synthetic anionic and nonionic compounds. The former are usually water-soluble alkalimetal salts or organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, ie 5 to 25 units of ethylene oxide per molecule, the condensation products of aliphatic ($C_8$–$C_{18}$) primary or secondary linear or branched alcohols with ethylene oxide, generally 6 to 30 EO, and products made by condensation of ethylene oxide with the reaction products of propylene and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in sudsintolerant automatic washing machines. We have also found that the use of some nonionic detergent compounds in the compositions decreases the tendency of insoluble phosphate salts to deposit on the washed fabrics, especially when used in admixture with some soaps as described below.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds. For example, mixtures of amine oxides and ethoxylated nonionic detergent compounds can be used.

Soaps may also be present in the detergent compositions of the invention, but not as the sole detergent compounds. The soaps are particularly useful at low levels in binary and ternary mixtures, together with nonionic or mixed synthetic anionic and nonionic detergent compounds, which have low sudsing properties. The soaps which are used are the sodium, or less desirably potassium, salts of $C_{10}$–$C_{24}$ fatty acids. It is particularly preferred that the soaps should be based mainly on the longer chain fatty acids within this range, that is with at least half of the soaps having a carbon chain length of 16 or over. This is most conveniently accomplished by using soaps from natural sources such as tallow, palm oil or rapeseed oil, which can be hardened if desired, with lesser amounts of other shorter chain soaps prepared from nut oils such as coconut oil or palm kernel oil. The amount of such soaps can be up to about 25% by weight, with lower amounts of about 0.5% to about 5% being generally sufficient for lather control. Amounts of soap between about 2% and about 20%, especially between about 5% and about 15%, can advantageously be used to give a beneficial effect on detergency and reduced levels of incrustation.

Apart from the essential detergent active compounds and detergency builders, the detergent compositions used in the process of the invention can contain any of the conventional additives in the amounts in which such materials are normally employed in fabric washing detergent compositions. Examples of these additives include lather boosters such as alkanolamides, particularly the monoethanolamides derived from palm kernel fatty acids and coconut fatty acids, lather depressants such as alkyl phosphates, waxes and silicones, antiredeposition agents such as sodium carboxymethylcellulose and polyvinyl pyrrolidone optionally copolymerised with vinyl acetate, oxygen-releasing bleaching agents such as sodium perborate and sodium percarbonate, per-acid bleach precursors, chlorine-releasing bleaching agents such as trichloroisocyanuric acid and alkalimetal salts of dichloroisocyanuric acid, fabric softening agents, inorganic salts such as sodium sulphate, sodium carbonate and magnesium silicate, and, usually present in very minor amounts, fluorescent agents, perfumes, enzymes such as proteases and amylases, germicides and colourants.

It is particularly beneficial to include in the detergent compositions an amount of sodium perborate, preferably between about 10% and 40%, for example about 15% to about 30% by weight. It has been found that the bleaching action of sodium perborate is boosted under highly alkaline conditions which also give optimum detergency and building action from the orthophosphate. Thus, it becomes possible to achieve improved bleaching properties by using the same levels of sodium perborate as normal; or decreased levels of sodium perborate can be used to give equal bleaching properties to those of conventional products with higher levels of perborate and sodium tripolyphosphate as the sole detergency builder. The latter option can also be used to further decrease the raw materials costs of the compositions, if a cheap filler is used in place of part of the sodium perborate.

It is desirable to include one or more antideposition agents in the detergent compositions of the invention, to decrease the tendency to form inorganic deposits on washed fabrics. It appears that the effective antideposition agents are materials which stabilise insoluble calcium orthophosphate particles and thereby inhibit their deposition onto the fabrics. The most effective antideposition agents are anionic polyelectrolytes, especially polymeric aliphatic carboxylates. The amounts of any such antideposition agent can be from about 0.01% to about 10% of the compositions, but is normally from about 0.1% to about 5% by weight, preferably from about 0.2% to about 2% by weight of the composition.

Specific preferred antideposition agents are the alkalimetal or ammonium, preferably the sodium, salts or homo- and co-polymers of acrylic acid or substituted acrylic acids, such as sodium polyacrylate, the sodium salt of copolymethacrylamide/acrylic acid and sodium poly-alpha-hydroxyacrylate, salts of copolymers of maleic anhydride with ethylene, acrylic acids, vinylmethylether, allyl acetate or styrene, especially 1:1 copolymers, and optionally with partial esterification of the carboxyl groups. Such copolymers preferably have relatively low molecular weights, eg in the range of about 1,000–50,000. Other antideposition agents include the sodium salts of polymaleic acid, polyitaconic acid and polyaspartic acid, phosphate esters of ethoxylated aliphatic alcohols, polyethylene glycol phosphate esters, and certain phosphonates such as sodium ethane-1-hydroxy-1, 1-diphosphonate, sodium ethylenediamine tetramethylene phosphonate, and sodium 2-phosphonobutane tricarboxylate. Mixtures of organic phosphonic acids or substituted acrylic acids or their salts with protective colloids such as gelatin may also be used. The most preferred antideposition agent is sodium polyacrylate having a MW of about 10,000 to 50,000, for example about 20,000 to 30,000.

It is also possible to include in the detergent compositions of the invention minor amounts, preferably not more than about 20% by weight, of other non-phosphate detergency builders or sequesterant builders. This is of particular benefit where it is desired to increase detergency whilst using particularly low levels of the essential alkalimetal pyro-phosphate and alkalimetal orthophosphate builders, so as to achieve especially low phosphorus contents in the detergent compositions. Examples of such other detergency builders are amine carboxylates such as sodium nitrilotriacetate, sodium carbonate, sodium amorphous or crystalline aluminosilicate ion-exchange materials, sodium citrate and soap, which can function as a detergency builder, as discussed above. However, such other builder materials are not essential and it is a particular benefit of using the mixed alkalimetal pyro-phosphate and orthophosphate that satisfactory detergency properties can be achieved at lower total phosphate levels than hitherto considered necessary without other detergency builders.

It is generally also desirable to include in the compositions an amount of an alkalimetal silicate, particularly sodium ortho-, meta- or preferably neutral or alkaline silicate. The presence of such alkalimetal silicates at levels of at least about 1%, and preferably from about 5% to about 15%, by weight of the composition, is advantageous in decreasing the corrosion of metal parts in washing machines, besides giving processing benefits and generally improved powder properties. The more highly alkaline ortho- and meta-silicates would normally only be used as lower amounts within this range, in admixture with the neutral or alkaline silicates.

The compositions of the invention are required to be alkaline, but not too strongly alkaline as this could result in fabric damage and also be hazardous for domestic usage. In practice the compositions should normally give a pH of from 9 to 11 in use in aqueous wash solution. It is preferred in particular for domestic products to have a minimum pH of at least 9.25 and especially a pH of 9.5 or over, as lower pHs tend to be less effective for optimum detergency building, and a maximum pH of 10.5, as more highly alkaline products can be hazardous if misused. The pH is measured at the lowest normal usage concentration of 0.1% w/v of the product in water of 12° H (Ca) (French permanent hardness, calcium only), at 50° C. so that a satisfactory degree of alkalinity can be assured in use at all normal product concentrations.

The pH of the detergent compositions in use is controlled by the amount of orthophosphate and any other alkaline salts such as alkalimetal silicate, sodium perborate and sodium carbonate present. The presence of such other alkaline salts, especially the alkalimetal silicates, is particularly beneficial, because the alkalinity of the alkalimetal orthophosphate is diminished in hard water due to precipitation of the calcium salt. The other ingredients in the alkaline detergent compositions of the invention should of course be chosen for alkaline stability, especially the pH sensitive materials such as enzymes.

The detergent compositions of the invention are preferably made in particulate form, by admixture of a spray dried base powder and treated pyro-phosphate. However, if desired, the detergent compositions may be compressed or compacted into tablets or blocks, or otherwise treated for example by granulation, prior to packaging and sale. To protect the compositions during storage it may be desirable to use moisture impermeable packaging for example in plastic or fabric sachets containing premeasured doses of the detergent compositions for washing machine usage.

The invention is illustrated by the following Examples in which parts and percentages are by weight except where otherwise indicated.

EXAMPLE 1

Experiments were carried out in a Tergotometer to demonstrate the effect of delayed addition of pyrophosphate on fabric incrustation. A detergent composition having the following formulation was made up by mixing solutions.

| Ingredient | % by weight |
|---|---|
| Alkyl benzene sulphonate | 6 |
| Nonionic detergent active | 2 |
| Sodium soap 30/70 coconut/hardened tallow | 3 |
| Sodium alkaline silicate | 10 |
| Sodium sulphate | 15 |
| Sodium chloride* | 9.5 |
| Sodium orthophosphate, Sodium pyro-phosphate, Sodium polyacrylate and water | balance |

*The sodium chloride was included to represent the ionic strength which could be expected from about 25% sodium perborate.

Fabrics were washed using this composition to which orthophosphate, pyro-phosphate and polyacrylate were added as set out below. The wash conditions were 40° FH wash water hardness (Ca:Mg 4:1), 30° FH flood and hand rinse water hardness (Ca:Mg 4:1), wash temperature 90° C., wash time 20 minutes, flood 2 minutes, rinse 5 minutes and product dosage 14 g per liter. The results achieved are set out in the following Table.

| orthophosphate | pyro-phosphate | | polyacrylate | % ash after |
|---|---|---|---|---|
| % | % delay | (min) | % | 15 washes |
| 6 | 6 | 0 | 0 | 8.8 |
| 6 | 6 | 5 | 0 | 5.6 |
| 6 | 6 | 0 | 2 | 4.7 |
| 6 | 6 | 5 | 2 | 3.7 |
| 6 | 11.6 | 0 | 0 | 8.4 |
| 6 | 11.6 | 5 | 0 | 6.5 |
| 6 | 11.6 | 0 | 2 | 7.2 |
| 6 | 11.6 | 5 | 2 | 3.8 |

It is clear from the above Table that the delayed addition of pyro-phosphate lowers the level of fabric incrustation, particularly in the presence of polyacrylate.

EXAMPLES 2 TO 7

By mixing solutions of the required ingredients in water having a hardness of 40° FH (Ca:Mg 4:1), basic wash liquors were prepared having the following composition.

| Ingredient | g/liter in wash liquor |
|---|---|
| Alkyl benzene sulphonate | 0.84 |
| Nonionic detergent active | 0.28 |
| Sodium coconut alkyl soap | 0.084 |
| Sodium stearic/palmitic soap | 0.336 |
| Sodium alkaline silicate | 1.4 |
| Sodium sulphate | 2.1 |
| Sodium chloride | 1.33 |

In these Examples the alkyl benzene sulphonate was DOBS-055, and the nonionic detergent active was Dobanol 45-13 EO.

To these basic wash liquors were added respectively various ingredients as set out below to form a first wash liquor which was used to wash cotton poplin fabric pieces in a Tergotometer. After a delay specified below further ingredients were added to the first wash liquor, also as set out below to form a second wash liquor. The fabrics were washed for a total of 20 minutes at 90° C., followed by a 2 minute flood and a 5 minute hand rinse in water having a hardness of 30° FH (Ca:Mg 4:1). After repeating this process 15 times without drying the fabrics inbetween, the fabrics were assessed for the deposition of insoluble material by a conventional ashing technique.

The details of each experiment were as follows.

| EXAMPLE | 2 | 3 | 4 | 5 | 6 | 7 |
|---|---|---|---|---|---|---|
| Ingredient added to form first liquor: | | | | | | |
| Sodium orthophosphate (g/l) | 0.84 | 0.84 | 0.84 | 0.84 | — | — |
| Sodium pyro-phosphate (g/l) | — | — | — | — | 0.84 | 0.84 |
| Ingredient added to form second liquor: | | | | | | |
| Sodium pyro-phosphate (g/l) | 0.84 | 0.84 | 0.84 | — | 0.84 | 0.84 |
| Coated pyro-phosphate (g/l) | — | — | — | 0.84 | — | — |
| Delay (minutes) | 0 | 1 | 5 | 0 | 0 | 5 |

The sodium orthophosphate was the hydrated trisodium salt, calculated in anhydrous terms. The sodium pyro-phosphate was the anhydrous tetrasodium salt. The coated pyro-phosphate was the hydrated disodium dihydrogen salt coated with a paraffin wax having a melting point between 49° C. and 62° C. The weight ratio of hydrated pyro-phosphate to coating was about 1:1.8, and the coated pyro-phosphate is calculated according to its equivalent weight of anhydrous tetrasodium pyro-phosphate.

The results were as follows.

| EXAMPLE | % Ash after 15 washes |
|---|---|
| 2 | 3.27 |
| 3 | 3.11 |
| 4 | 2.94 |
| 5 | 1.99 |
| 6 | 4.94 |
| 7 | 4.83 |

A comparison of Examples 2 and 3 demonstrates that a detectable benefit occurs where the pyrophosphate is delayed for 1 minute. Where the delay is extended to 5 minutes in Example 4, the reduction in deposition on the fabrics is more apparent. Example 5, when compared with Example 2, shows the benefit of delaying the solubility of the pyro-phosphate by coating with wax. A comparison of Examples 6 and 7 with Examples 2 and 4 respectively, shows that reduced levels of deposition on the fabrics does not occur if the orthophosphate in the first liquor is replaced by pyro-phosphate, thereby demonstrating that it is the delayed use of pyro-phosphate which leads to the benefit of the present invention rather than the use of pyrophosphate itself.

I claim:

1. A process for washing fabrics comprising the steps of:

(i) contacting the fabrics with a wash liquor containing a synthetic detergent active compound and an alkalimetal or ammonium orthophosphate; and (ii) subsequently dissolving into the wash liquor an alkalimetal or ammonium pyrophosphate, said wash liquor having a pH between about 8 and about 12 and said wash liquor containing substantially no alkalimetal or ammonium polymerphosphate, the fabrics being in contact with said wash liquor containing said orthophosphate till at least half the calcium hardness has precipitated as a macroscopic calcium orthophosphate precipitate before contacting the fabrics with pyrophosphate.

2. A process according to claim 1, characterized in that the wash liquor used in step (i) remains in contact with the fabrics for at least one minute before contacting the fabrics with pyrophosphate of step (ii).

3. A process according to claim 1, characterised in that step (ii) is carried out between 5 minutes and 30 minutes after step (i).

4. A process according to claim 1, characterised in that said alkalimetal or ammonium pyro-phosphate is present in the wash liquor used in step (i) in an undissolved form.

5. A process according to claim 1, further comprising a polymeric aliphatic carboxylate salt.

6. A process according to claim 5, wherein the polymeric carboxylate salt is sodium polyacrylate.

* * * * *